US005167345A

United States Patent [19]

Bleeker

[11] Patent Number: 5,167,345

[45] Date of Patent: Dec. 1, 1992

[54] DUAL DISPENSER

[75] Inventor: Raymond A. Bleeker, Norwalk, Calif.

[73] Assignee: Bobrick Washroom Equipment, Inc., North Hollywood, Calif.

[21] Appl. No.: 735,650

[22] Filed: Jul. 25, 1991

[51] Int. Cl.[5] ..... G07F 11/00

[52] U.S. Cl. ..... 221/17; 221/103; 221/131; 221/151; 221/232; 221/273; 221/298; 221/301

[58] Field of Search ..... 271/17-20, 271/103, 108, 111, 123, 131, 133, 151, 194, 195, 226, 232, 273, 272, 274, 276, 298, 299, 301

[56] References Cited

U.S. PATENT DOCUMENTS

| | | | |
|---|---|---|---|
| 427,093 | 6/1890 | Lennon . | |
| 463,847 | 11/1891 | Tollner . | |
| 630,661 | 8/1899 | Cody . | |
| 1,119,683 | 12/1914 | Cayo . | |
| 1,151,539 | 8/1915 | Grover et al. | 221/17 |
| 1,210,520 | 1/1917 | Oliver . | |
| 1,330,964 | 2/1920 | Wheelwright . | |
| 1,418,093 | 5/1922 | Parmater . | |
| 1,648,813 | 11/1927 | Kelly | 221/108 |
| 1,814,795 | 7/1931 | Giles . | |
| 2,279,936 | 4/1942 | Brodie et al. . | |
| 2,399,612 | 5/1946 | Auerbach . | |
| 2,444,747 | 7/1948 | Niewoehnee | 221/151 |
| 2,585,872 | 1/1952 | Steiner . | |
| 2,643,929 | 6/1953 | Keefe | 221/17 |
| 2,816,719 | 12/1957 | Richert . | |
| 2,852,159 | 9/1958 | Klein | 221/301 |
| 2,870,937 | 1/1959 | Telly . | |
| 2,957,605 | 10/1960 | Gabrielsen | 221/18 |
| 3,002,653 | 10/1961 | Danziger . | |
| 3,105,610 | 10/1963 | Aidlin et al. . | |
| 3,819,087 | 6/1974 | Schuller et al. | 221/123 |

FOREIGN PATENT DOCUMENTS

| | | |
|---|---|---|
| 233881 | 10/1963 | Austria . |
| 1091785 | 10/1960 | Fed. Rep. of Germany . |
| 788093 | 12/1957 | United Kingdom . |

*Primary Examiner*—H. Grant Skaggs
*Attorney, Agent, or Firm*—Harris, Kern, Wallen & Tinsley

[57] ABSTRACT

A dual dispenser for dispensing a first type of article from first and second stacks of the first articles and a second type of article from a stack of the second articles. The dispenser includes a housing having first and second magazines for holding the stacks of the first articles and a third magazine for holding the stack of the second articles, with a single article discharge slot in the housing and with means within the housing for movement of articles from each of the stacks to the discharge slot. The dispenser also includes means for moving the first type of articles from the bottom of the first stack and then from the bottom of the second stack, and from moving articles of the second type from the bottom of the third magazine. The dispensing may be controlled by coin mechanisms for each type of article or may be free, no-coin operation.

16 Claims, 6 Drawing Sheets

DUAL DISPENSER

BACKGROUND OF THE INVENTION

The present invention relates to devices for dispensing articles, typically operated by a customer by depositing a coin and moving a lever or shaft or pushing a button. Some vending machines or dispensers are free standing, while others are flush mounted in walls. Space restrictions at vending locations place both frontal limitations and depth limitations on the dispensers. At the same time, it is highly desirable to utilize as much of the volume of the dispenser as possible for storing the articles to be dispensed, so that restocking activity is reduced. Also, it is desirable to be able to dispense more than one type of article from a single dispenser installation for more efficient use of space, installation requirements, and restocking activity.

A wide variety of dispenser configurations have been utilized in the past. It is an object of the present invention to provide a dispenser utilizing two magazines for holding the same article, with a single mechanism for emptying one magazine and then the other. It is another object of the invention to provide such a dispenser with an additional magazine for holding a different article, with a mechanism for emptying this magazine, and with both types of articles from the three magazines being discharged at a single outlet slot in the magazine housing.

It is a particular object of the invention to utilize such a configuration to obtain a compact design with a minimal frontal area and a minimal depth, while achieving a maximum article storage capacity within the overall volume of the dispenser.

Prior art dispenser mechanisms are known utilizing two magazines positioned side by side with articles being dispensed alternately from each magazine. This type of dispenser mechanism requires considerabe volume and an overall housing with a depth in order of six to eight inches. One of the specific objects of the present invention is to provide a dispenser with a housing depth of only four inches, so that the dispensers can be mounted in a conventional wall construction, either recessed or flush.

These and other objects, advantages, features and results will more fully appear in the course of the following description.

The specific embodiment of the invention disclosed is a sanitary napkin and tampon vending machine wherein the napkins are individually packed in boxes of a shape and size similar to that of cigarette boxes and individual serving cereal boxes. The tampons are individually packed in a cigar shape, about 7/8 inches diameter and four inches long. However the dispenser of the invention is not limited to this specific purpose and can be utilized for dispensing candy, cigarettes and other articles.

SUMMARY OF THE INVENTION

A sanitary napkin and tampon vending machine. The napkin dispenser comprises two parallel vertical magazines for containing napkin boxes, and an ejection mechanism at the bottom which empties the first magazine and then the second magazine. A dummy box is placed on top of the articles in the second magazine and another dummy box is placed on top of the articles in the first magazine. The dummy boxes serve as weights and other control purposes; the dummy box in the first magazine serves as part of the ejection mechanism for the second magazine when the first magazine is exhausted.

The dispensing mechanism includes a pusher plunger which is moved when a dispensing knob is pulled. When there are articles in the first magazine, the plunger moves, pushing the lowest article out of the magazine, down a slide and into a trough at the vending opening slot. When all articles have been dispensed from the first magazine, its dummy box rests on the bottom, with the plunger within an opening in the dummy box. The plunger now moves the dummy box and brings the pusher fingers in the dummy box into engagement with the lowest article in the second magazine pushing this article out and down the slide to the opening slot. When the second magazine is exhausted, a projection in the dummy box of the second magazine, engages a lever which in turn moves a flag in position over the coin slot.

The dispensing mechanism of the tampon magazine includes a lower plate and an upper plate both connected to a dispensing knob through a pivot arrangement. When the knob is pulled, the lower plate is moved out of a blocking position permitting the lowermost article to drop down to the dispensing opening slot. At the same time the upper plate is moved to support the remaining articles. When the knob is released, the lower plate and the upper plate move back to their original positions. A similar dummy box projection is used to move a flag over the second coin slot when the tampon magazine is empty.

DESCRIPTION OF THE PREFERRED EMBODIMENT

Figure 1:
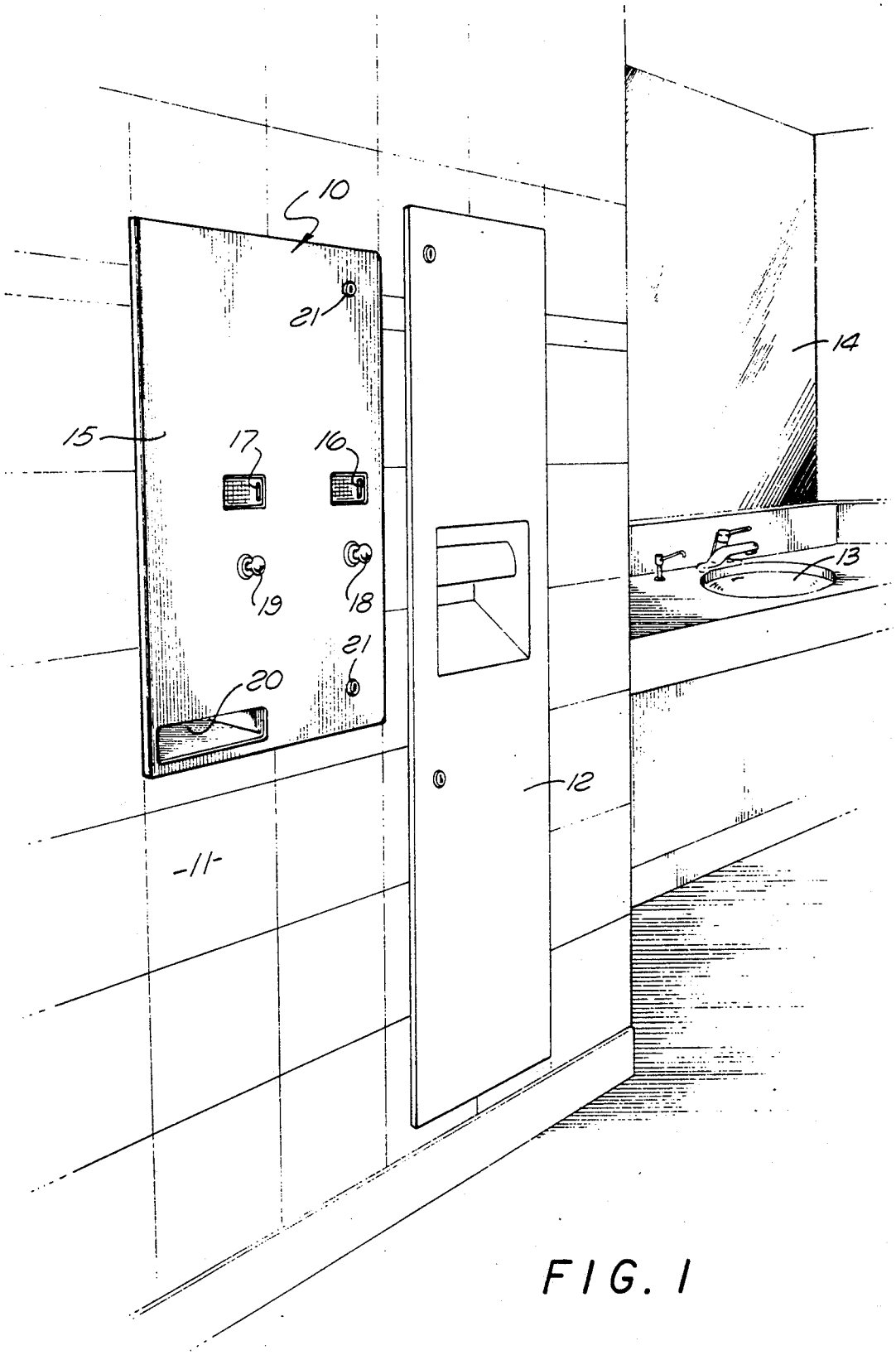
FIG. 1 is a view of a wall of a washroom with the presently preferred embodiment of the dispenser of the invention mounted in the wall, showing the front face of the dispenser.

FIG. 1 shows a dispenser 10 mounted in a wall 11 of a washroom, which also includes a towel case 12, a basin 13 and a mirror 14. The dispenser is flush mounted in the wall with the dispenser front panel 15 closing the front of the dispenser housing. Coin slots 16, 17, customer operating knobs 18, 19, and an article discharge opening 20 are incorporated in the dispenser. Locks 21 provide for removal of the panel for access to the interior of the dispenser.

The dispenser includes magazines 24, 25 and 26 for holding stacks of articles and typically are manufactured in the conventional manner of sheet metal pieces welded or otherwise fastened together. Stacks of articles to be dispensed are loaded into each of the magazines. In the specific embodiment illustrated, boxes 27 of a first article, typically a sanitary napkin box, are loaded into the magazines 24 and 25, and cylindrical packages 28 of individual tampons are loaded into the magazine 26. Dummy boxes 29, 30, and 31 are positioned on top of the stacks in the respective magazines 24, 25, 26. The magazine 24 includes a bottom member 32, magazine 25 includes a bottom member 33, and magazine 26 includes a bottom member 34, with the stacks of articles resting on the respective bottom members. A coin box and coin detection mechanism 35 is provided for each coin slot and knob. Alternatively, the dispenser can be set for free, no-coin operation.

A plate 38 provides a discharge passage from the magazine 24 to the floor 39 at the discharge opening 20. Preferably, another plate 40 is positioned above the plate 38 to define the upper limit of the discharge passage. Plates 42, 43 provide a similar discharge passage for the magazine 25.

Figure 2:
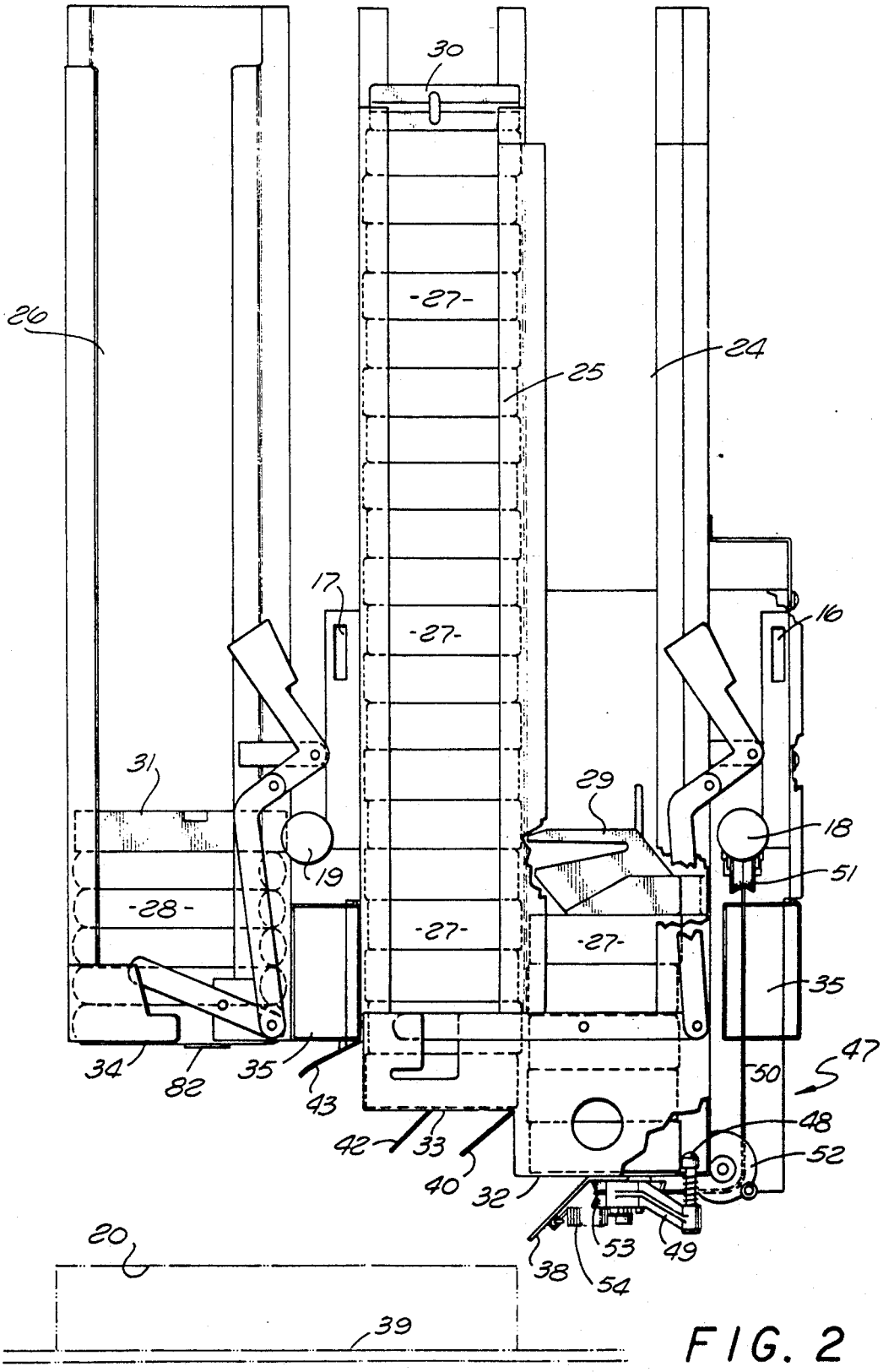
FIG. 2 is a front view of the dispenser of FIG. 1, with the front panel removed, showing the dispenser in the partly loaded condition.

An actuating mechanism 47 (FIG. 2) provides for moving an article from the bottom of the stack in the magazine 24, into the discharge passage formed by the plates 38, 40, and onto the floor 39 at the discharge opening 20. In the preferred embodiment illustrated, the actuating mechanism includes a pusher member 48 carried on a swing arm 49 which is driven by a cable 50 running from the knob 18 over pulleys 51, 52, 53. Pulling on the knob 18 moves the swing arm from the position shown in solid lines in FIG. 5 to the position shown in phantom lines. When the knob is released, the arm 49 is returned to the position of FIGS. 2–4 and solid lines in FIG. 5 by a spring 54.

Figure 6:
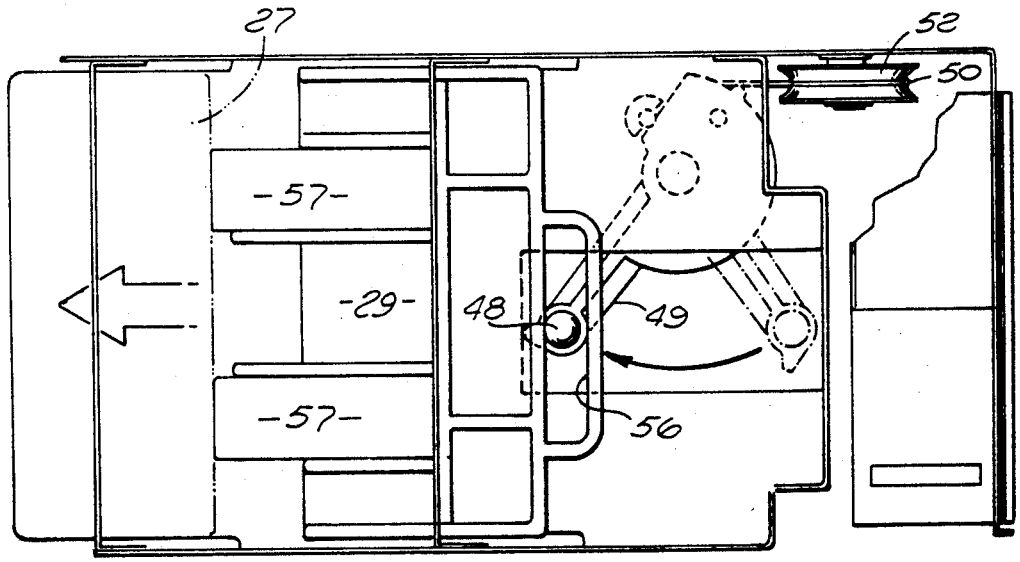

This operation is repeated until the magazine 24 is empty, with the dummy box 29 resting on the bottom of the magazine. A vertical slot 56 is provided in the dummy box 29 (FIGS. 4 and 6), with the pusher member 48 being positioned in the slot 56 when the dummy box is resting on the bottom of the magazine. The dummy box 29 has an upper finger or fingers 57 positioned above the bottom portion of the dummy box, defining a lateral slot 58. After the magazine 24 is empty, actuation of the knob 18 by the next customer causes the pusher member 48 to push the dummy box 29 from the position shown in solid lines in FIG. 4 to the position shown in phantom lines. When this occurs, the fingers 57 move into the magazine 25 above the bottom member 33, engaging the lowest article in the magazine 25 and pushing it into the discharge passage for dropping onto the floor 39 at the discharge opening 20. When the customer releases the knob 18, the spring 54 returns the swing arm 49 and the dummy box 29 to the normal position. In FIG. 6, the crank arm is shown in phantom lines in the normal position, with the dummy box and swing arm shown in solid lines in the position for pushing an article from the bottom of the stack in the magazine 25.

Figure 3:
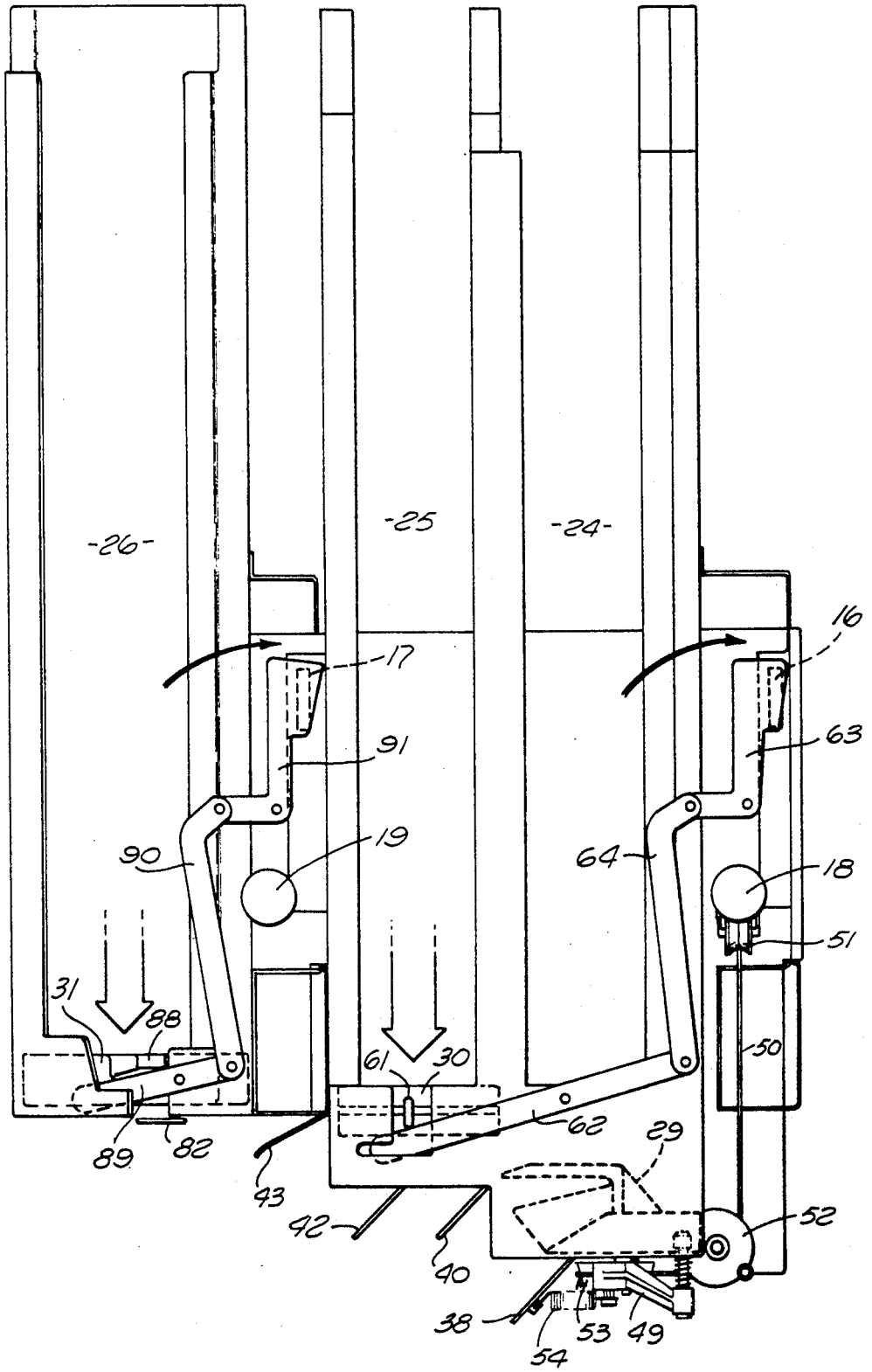
FIG. 3 is a view similar to that of FIG. 2 showing the dispenser in the empty condition.
Figure 4:
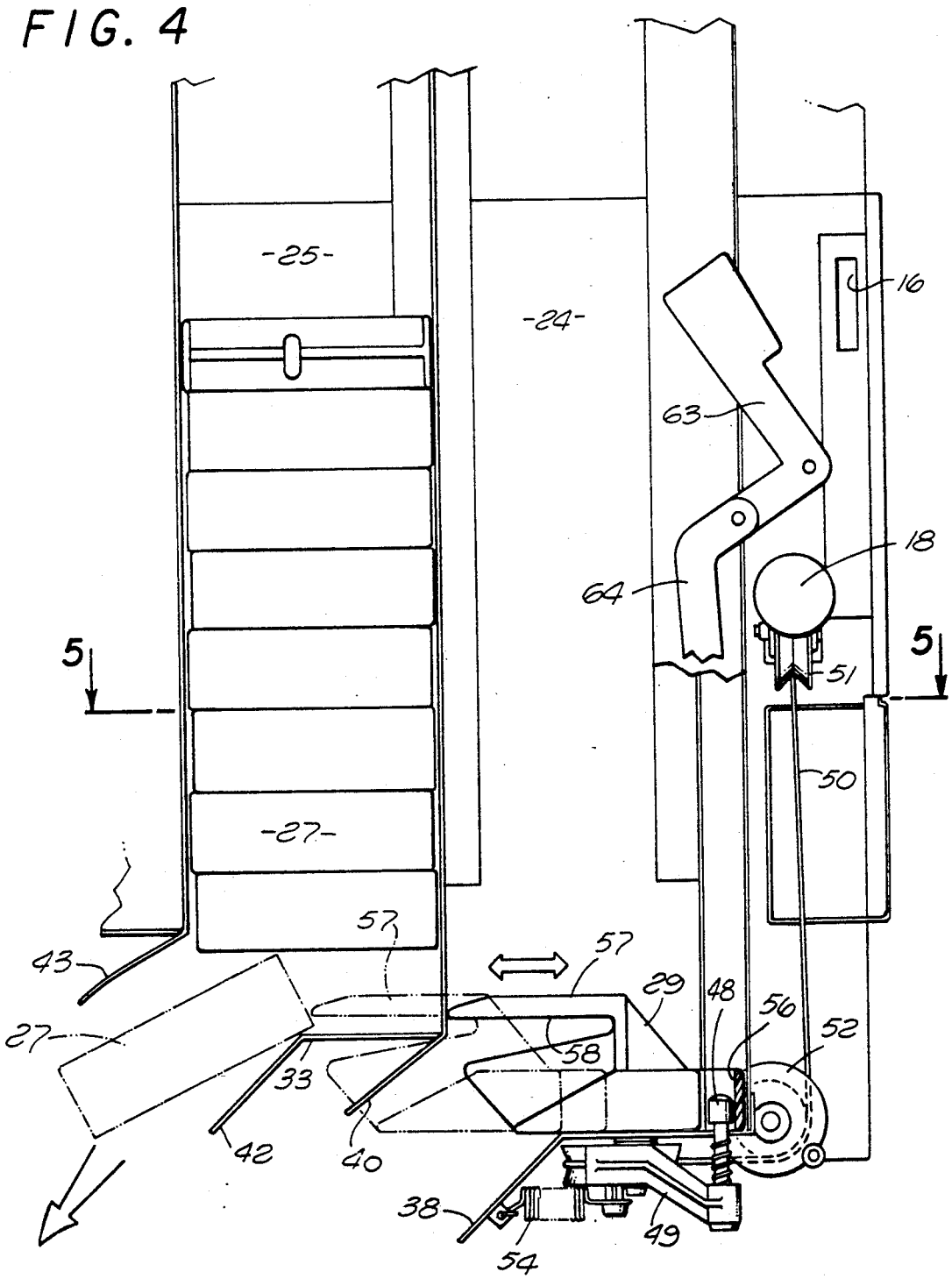
FIG. 4 is an enlarged partial view similar to that of FIGS. 2 and 3, showing a pair of magazines and illustrating the operation of the mechanism with the first magazine empty.

Dispensing of articles from the magazine 25 continues until this magazine is empty. At this time, the dummy box 30 rests on the bottom member of the magazine 25 and a boss 61 on the dummy box engages a lever 62 which is coupled to another lever 63 by a connecting arm 64. The lever 62 is rotated counterclockwise as shown in FIG. 3 and moves the upper end of the lever 63 into a position over the coin slot 16, to serve as a flag for preventing insertion of another coin.

Figure 5:
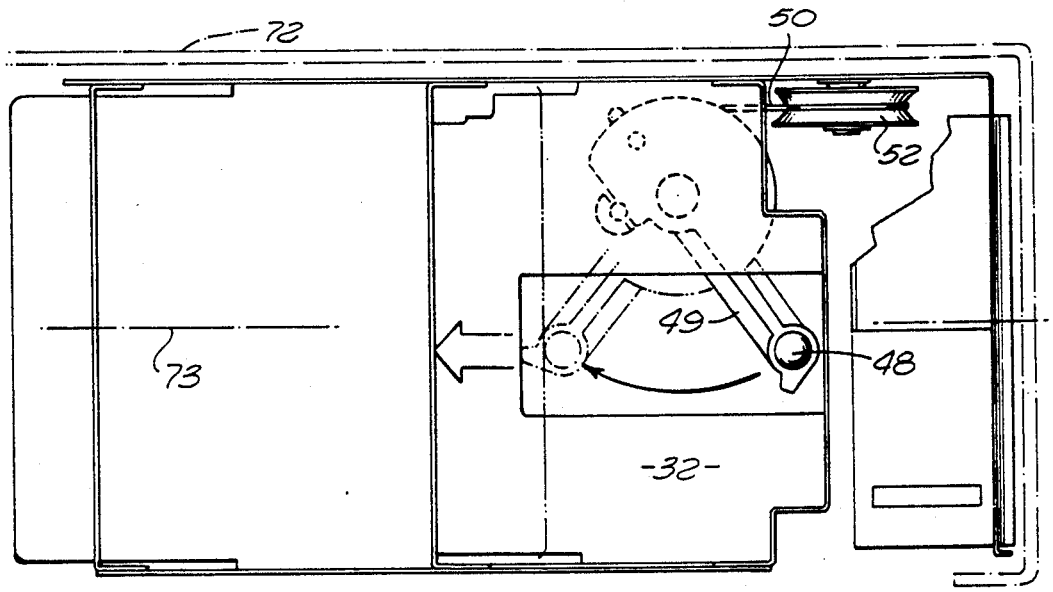
FIGS. 5 and 6 are sectional views taken along the line 5—5 of FIG. 4, illustrating the operation of the mechanism.
Figure 7:
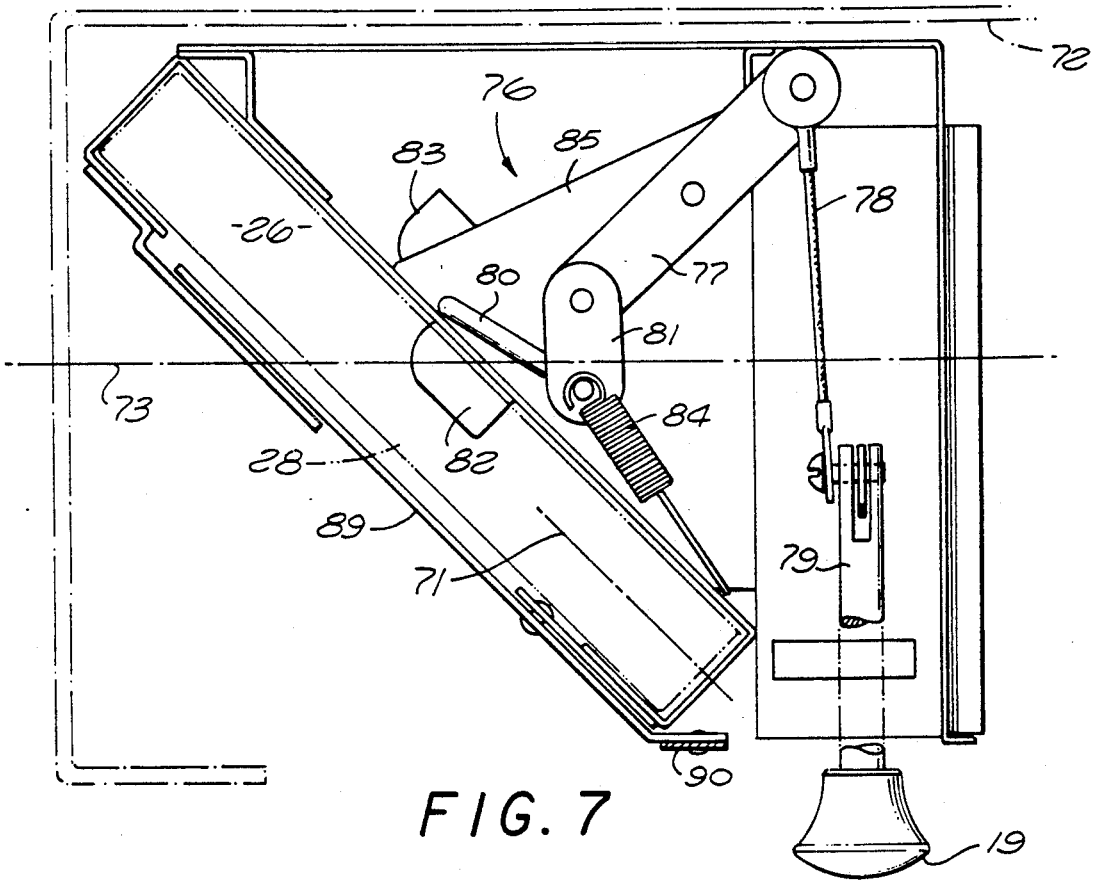
FIGS. 7 and 8 are top views of the single magazine illustrating the operation of the mechanism.

The magazine 26 is rectangular in plan with a longitudnal axis 71 (FIG. 7), and the housing 72 in which the magazines and actuating mechanisms are mounted also has a rectangular plan with a longitudnal axis 73 (FIGS. 5 and 7). The magazine 26 is oriented in the housing 72 with the longitudnal axis 71 oblique to the longitudnal axis 73, preferably at about 45 degrees. This orientation permits dispensing of an article 28 within a housing of limited width and limited depth. In particular, this permits construction of a dispenser with a depth of not more than 4 inches so that the dispenser can be installed in a conventional wall, while at the same time maintaining the conventional dispenser housing width of not more than 14⅝ inches and having three magazines therein.

Figure 8:
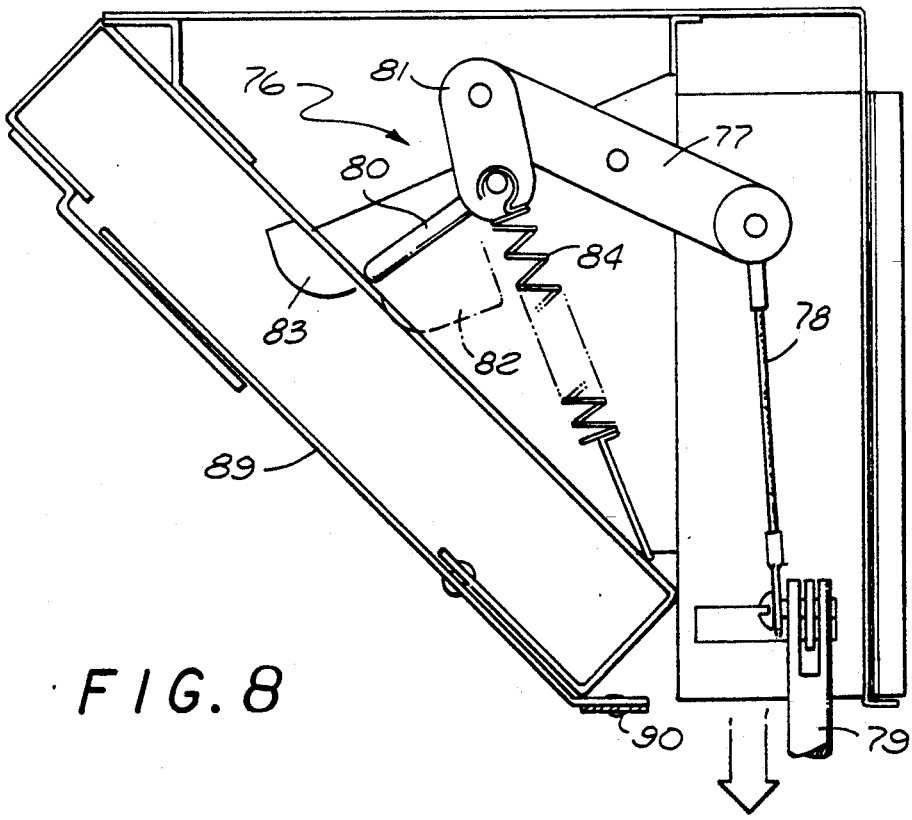

An escapement mechanism 76 (FIGS. 7 and 8) provides for dropping the articles 28 one at a time from the magazine 26 onto the floor 39 at the discharge opening 20. The escapement mechanism includes a pivoted arm 77 driven by a link 78, typically a cable, from a shaft 79 of the knob 19, with the arm 77 driving a swing arm 80 about a vertical axis through another link 81. A lower plate 82 and an upper plate 83 are carried on the vertically oriented shaft of the swing arm 80. The plates 82, 83 are shown in the normal position in FIG. 7 and in the dispensing position in FIG. 8. The mechanism is moved from the position of FIG. 7 to the position of FIG. 8 by pulling on the knob 19 and, after the knob is released, the mechanism is returned from the position of FIG. 8 by a spring 84. The vertical shaft portion of the swing arm 80 is carried in a plate 85.

The magazine 26 has an opening at the bottom which permits the articles 28 to drop therethrough. When in a normal position, the lower plate projects into the open bottom of the magazine (FIG. 7), with the stack of articles resting on this plate. When moved to the dispensing position of FIG. 8, the upper plate 83 moves into position between the lowest article in the stack and next lowest article, while the lower plate 82 moves out of the magazine, to the position shown in FIG. 8. With this arrangement, the lowest article drops from the magazine with the remainder of the stack resting on the upper plate 83. When the knob is released, the mechanism returns to the position of FIG. 7 and the stack drops onto the lower plate 82. The lower and upper plates are mounted on the swing arm 80 in vertical spaced relation and an angularly spaced relation, with the vertical spacing depending upon the size of the article to be dispensed and with the angular spacing depending upon the amount of motion required for the lower plate to clear the magazine.

When the magazine 26 is empty, a boss 88 on the dummy box 31 engages a pivoted lever 89 which, through a link 90, moves a pivoted lever 91 to place a flag over the coin slot 17 (FIG. 3).

Thus it is seen that by positioning the actuating means 47 below the magazines 24, 25, the dispenser can be constructed with a horizontal area for dispensing the articles 27 which is not significantly larger than the horizontally area of the two magazines. Similarly, by orienting the magazine 28 obliquely and positioning the escapement mechanism 76 in one of the triangular areas adjacent the magazine, the horizontal area occupied by the magazine 26 and its dispensing mechanism is reduced. With this arrangement, three magazines can be incorporated in the space previously required for two magazines and more product can be dispensed from a given space. While two coin slots and actuating knobs are required for customer selection of the article to be dispensed, the front panel space requirement is reduced, the need for the customer to choose between outlet slots is alleviated, and the front panel appearance is enhanced by the arrangement which directs articles from all three magazines to a single discharge slot.

I claim:

1. In a dispenser for dispensing articles from first and second stacks of articles, and having a first magazine for holding a first stack of articles resting on a first floor member, and a second magazine for holding a second stack of articles resting on a second floor member, the improvement including in combination:

a first dummy box for said first magazine for resting on said first stack;

a second dummy box for said second magazine for resting on said second stack; and first actuating means for moving an article from the bottom of said first stack for passing under said second stack to a discharge position, with said actuating means including a pusher member pivotable about a vertical axis from a first position away from said first stack to a second position engaging a side of the lowest item in said first stack for moving said lowest item towards said second stack, and for engaging a side of said first dummy box as said lowest item of said first stack after articles are dispensed from said first stack.

2. A dispenser as defined in claim 1 including:

a third magazine for holding a third stack of articles; and an escapement mechanism for releasing articles one at a time from the bottom of said third stack, said escapement mechanism including a shaft mounted in said dispenser for rotation about a vertical axis, upper and lower plates mounted on said shaft in vertical spaced relation and in angular spaced relation, and second actuating means for rotating said shaft, said third magazine having an open bottom with said lower plate normally positioned at said open bottom for supporting said third stack and with said upper plate normally positioned out of said third magazine, with said upper plate movable into said third magazine between the lowest and the next lowest article in said third stack and with said lower plate movable out of said third magazine on rotation of said shaft to dispense the lowest article.

3. A dispenser as defined in claim 2 wherein said second actuating means includes means for reciprocating movement of said shaft about said vertical axis for moving said upper plate out of said third magazine and moving said lower plate into said third magazine after dispensing an article for permitting the remainder of said third stack to move downward onto said lower plate.

4. A dispenser as defined in claim 3 wherein said second actuating means includes a swing arm, a customer operated cable for rotating said swing arm in one direction, and spring means for rotating said swing arm in the opposite direction.

5. A dispenser as defined in calim 4 including a coin operated access mechanism for limiting customer operation of said swing arm.

6. A dispenser as defined in claim 5 wherein said coin operated access mechanism includes a coin slot, and including a lever mechanism positioned between said third magazine and said coin slot, and a third dummy box for said third magazine for resting on said third stack and including a lever engaging means for engaging said lever mechanism when said third magazine is empty of articles with said third dummy box at said bottom of said third stack for actuating said lever mechanism to cover said coin slot.

7. A dispenser as defined in claim 2 wherein said third magazine is rectangular in plan with a first longitudinal axis, and including a housing for said dispenser which is rectangular with a second longitudinal axis, and means for positioning said third magazine in said housing with said first axis oblique to said second axis.

8. In a dispenser for dispensing articles from first and second stacks of articles, and having a first magazine for holding a first stack of articles resting on a first floor member, and a second magazine for holding a second stack of articles resting on a second floor member, the improvement including in combination:

a first dummy box for said first magazine for resting on said first stack;

a second dummy box for said second magazine for resting on said second stack; and actuating means for moving an article form the bottom of said first stack for passing under said second stack to a discharge position, with said actuating means including a pusher member movable form a first position away from said first stack to a second position engaging the lowest item in said first stack for moving said lowest item towards said second stack, said pusher member including means for engaging said first dummy box as said lowest item of said first stack after articles are dispensed from said first stack, and with said first dummy box including pushing means for engaging the lowest item in said second stack for moving said second stack lowest item toward said discharge position when said first dummy box is moved by said pusher member.

9. A dispenser as defined in claim 8 wherein said first dummy box includes:

a bottom for sliding on said first magazine floor member;

means defining a lateral slot above said bottom with said pushing means above said slot; and means defining a vertical slot opposite said lateral slot for engagement by said pusher member for reciprocating movement of said first dummy box by said pusher member whereby said second magazine floor member enters said first dummy box lateral slot with said first dummy box pushing means above said second magazine floor member.

10. A dispenser as defined in claim 8 wherein said pusher member includes a swing arm, a customer operated cable for rotating said swing arm in one direction, and spring means for rotating said swing arm in the opposite direction.

11. A dispenser as defined in claim 10 including a coin operated access mechanism for limiting customer operation of said swing arm.

12. A dispenser as defined in claim 11 wherein said coin operated access mechanism includes, a coin slot, and including a lever mechanism positioned between said second magazine and said coin slot, with said second dummy box including a lever engaging means for engaging said lever mechanism when said second magazine is empty of articles with said second dummy box at said second magazine floor member for actuating said lever mechanism to cover said coin slot.

13. A dispenser as defined in claim 8 including a first discharge plate positioned obliquely between the bottom of said first magazine and said discharge position and a second discharge plate positioned above said first discharge plate for defining a discharge passage.

14. In a dispenser for dispensing articles from first and second stacks of articles, and having a first magazine for holding a first stack of articles resting on a first floor member, and a second magazine for holding a second stack of articles resting on a second floor member, the improvement including in combination:

a first dummy box for said first magazine for resting on said first stack; and actuating means for moving an article from the bottom of said first stack for passing to a discharge position, said actuating means including a pusher member movable from a first position away from said first stack to a second position engaging the lowest item in said first stack for moving said lowest item towards said second stack, said first dummy box including:

pushing means for engaging the lowest item in said second stack for moving said second stack lowest item toward said discharge position when said first dummy box is moved by said pusher member, a bottom for sliding on said first magazine floor member, means defining a lateral slot above said bottom with said pushing means above said slot, and means defining a vertical slot opposite said lateral slot for engagement by said pusher member for reciprocating movement of said first dummy box by said pusher member whereby said second magazine floor member enters said first dummy box lateral slot with said first dummy box pushing means above said second magazine floor member.

15. In a dispenser for dispensing first and second types of articles from a single location, and having first magazine means for holding a stack of the first articles and second magazine means for holding a stack of the second articles, the improvement including in combination:

a housing having a single outlet slot with an article supporting floor within said housing at said slot, and with said first and second magazine means positioned within said housing, with one of said magazine means including means defining discharge passage means between the lower end of said one magazine means and said floor for guiding articles from said one magazine means to said floor, and with the other of said magazine means positioned with its lower end above said floor for dropping articles onto said floor, with said one magazine means including a first magazine for holding a first stack of the first articles, a second magazine for holding a second stack of the first articles, and further including magazine delivery means for depositing articles into said discharge passage means for transfer from said first magazine to said floor, and when said first magazine is empty, for depositing articles from said second magazine into said discharge passage means to said floor, and with said magazine discharge means including a reciprocating pusher member for pushing the lowest article in said first magazine stack into said discharge passage means, and a dummy box for positioning on the top of the stack of articles in said first magazine, said dummy box including means for engagement with said reciprocating pusher member for reciprocating said dummy box when the stack of articles in said first magazine is depleted, and with said dummy box including means for engaging the lowest article in the stack in said second magazine for moving said lowest article from said second magazine into said discharge passage means when said dummy box is reciprocated.

16. A dispenser as defined in claim 15 wherein said other magazine means includes a third magazine for said second type of articles, and wherein said magazine discharge means includes an escape mechanism for cyclically positioning a lower stack supporting plate at the bottom of the stack of articles in said third magazine and an upper stack supporting plate between the lowest and next lowest article in said stack for dropping said second type of articles one at a time from said third magazine to said article supporting floor.

* * * * *